United States Patent [19]

Rozema

[11] Patent Number: 4,729,540

[45] Date of Patent: Mar. 8, 1988

[54] GROUT RETAINING TOOL

[76] Inventor: Donald W. Rozema, P.O. Box 913, Riverton, Utah 84065

[21] Appl. No.: 879,036

[22] Filed: Jun. 26, 1986

[51] Int. Cl.[4] ..... E04G 23/02

[52] U.S. Cl. ..... 249/1; 52/303; 220/243; 220/323; 249/19; 249/192; 249/219 R; 264/36

[58] Field of Search ..... 249/1, 2, 14, 15, 19, 249/47, 189, 192, 195, 196, 219 R; 264/30, 36, 31; 220/243, 251, 323, 3.4, 3.6; 52/303, 305

[56] References Cited

U.S. PATENT DOCUMENTS

| | | | |
|---|---|---|---|
| 338,825 | 3/1886 | Carlin | 220/251 X |
| 848,917 | 4/1907 | McElligott et al. | 98/118 |
| 1,311,082 | 7/1919 | Mock | 52/421 |
| 1,355,595 | 10/1920 | Eickhoff | 52/303 |
| 1,517,677 | 12/1924 | Heinkel | 220/243 |
| 2,610,381 | 9/1952 | Rosati et al. | 249/2 |
| 2,863,207 | 12/1958 | Davis et al. | 249/14 |
| 3,142,882 | 8/1964 | Lovers | 249/14 X |
| 3,212,155 | 10/1965 | Francis, Jr. | 249/14 |
| 3,231,646 | 1/1966 | Conder et al. | 264/80 |
| 3,711,059 | 1/1973 | Kistler | 249/47 X |
| 3,729,165 | 4/1973 | Trimble | 249/1 X |
| 4,386,486 | 6/1983 | Holt et al. | 52/125.5 |
| 4,610,566 | 9/1986 | Albang et al. | 249/1 X |

OTHER PUBLICATIONS

NCMA-TEK, an information series from National Concrete Masonry Association (1975).

Standards entitled "Non-Foods Distribution Center", Unit Masonry, pp. 04200-9 and 04200-10.

*Primary Examiner*—Richard L. Chiesa

*Attorney, Agent, or Firm*—Workman, Nydegger & Jensen

[57] ABSTRACT

A tool which can be used to temporarily close cleanout holes in masonry construction and which can be securely anchored directly to the masonry wall.

The present invention is essentially comprised of a substantially flat plate of rigid material. The plate of the present invention is configured such that it fully covers the cleanout holes for which it is designed. Furthermore, the planar surface of the plate is configured such that it provides an acceptable grout surface on the interior of the cleanout hole once it is filled. Securely attached to the plate is means for locking the plate into position within the cleanout hole and for securing the plate directly to the masonry wall in which the device is used. Various different locking mechanisms are within the scope of the invention.

24 Claims, 8 Drawing Figures

GROUT RETAINING TOOL

BACKGROUND

1. Field of the Invention

The present invention is related to tools used in masonry work. In particular, the present invention is related to tools for use in temporarily closing openings in masonry while the masonry is grouted, or filled with like material.

2. Background of the Invention

The general art of masonry work is, of course, an extremely old art. In essence, masonry work involves binding together "masonry units" such as bricks, blocks, and stone. These masonry units are held together with some type of mortar.

In modern construction, the mortar is made up of several separate components, which components may be varied depending on the desired characteristics of the mortar. One of the primary elements of mortar is a cement component which contributes strength and durability to the mortar mix. In addition, lime may be added to the mortar to add workability, the ability to retain water, and elasticity. Both cement and lime components contribute to the bond strength of the mortar mix.

In addition, sand may be added which acts as a filler and which also contributes to the strength of the mix. Sand enables the unset mortar mix to retain its shape and thickness under the pressure of several masonry units. A final component of mortar is generally water which acts as a mixing agent and gives workability to the resulting mortar mix.

As mentioned above, the various components of mortar may be varied in order to provide various types of properties. The desired properties will, of course, depend on the expected use of the mortar mix. Mortar mixes may vary from extremely thick mortars used to hold together stone and block, to very thin mortars, such a grout, which are used to fill voids within the masonry structure.

Grout is generally defined as a thin, or wet mortar. This thin, wet mortar may be added to the interior of a masonry structure to fill the voids within the interior. In addition, it may be added to other portions of the structure to fill voids or to provide additional strength at desired locations.

Grout is a particularly important structural element when using concrete blocks. Conventional concrete blocks include hollow voids within the blocks. When constructing large structures using this type of block, it is necessary to provide additional reinforcement to the interior of the structure. As a result, it is conventional in the art to add structural steel rod which runs through the interior of the hollow concrete blocks.

Increasingly, rigid construction codes also now typically require that the interior of concrete block construction be supplemented with a grout material. Thus, it is typical to fill voids within concrete blocks with a thin, wet grout material.

In order to confirm that the grout material has flowed through the entire masonry wall, construction codes now typically require that "cleanout holes" be provided at the base of each of the channels through which the grout flows. Such grout channels are often referred to as "pours." A typical state building code provides that "cleanout openings shall be provided at the bottom of each pour of grout. Any overhanging mortar or other debris shall be removed from the insides of cell walls. The foundation or other horizontal construction joints shall be cleaned of all loose material and mortar droppings before each pour. The cleanout shall be sealed before grouting." See Utah State Building Code § 2-2415(c).

The purpose of cleanout holes is readily apparent. These openings allow an inspector to confirm that a high-rise masonry wall has been properly grouted and to observe that grout has flowed all the way to the base of each channel or pour within the wall. In addition, such cleanout holes are required in order to remove certain debris, such as mortar droppings and the like, which may have fallen through the openings in the interior of a concrete block or similar building material and which may obstruct the pouring of the grout.

The problem which is encountered in providing such cleanout holes, however, is with respect to closing the cleanout hole during the pouring of grouting. It will be appreciated that, with a "high lift" masonry wall, the fluid pressure of grout against the cleanout hole opening may be extremely large. Thus, it has been a problem to provide adequate means of blocking the cleanout hole while it is being filled with grout.

The present practice in the art is simply to fill the cleanout hole with some type of makeshift cover. The cover may include an appropriately shaped piece of plywood which is wedged within the hole. The cover then may be braced by an external brace, such as a wood structure wedged against the wall. The existing methods, however, do not rely on the masonry wall itself in order to brace the cover in place during grouting.

In using such makeshift coverings, additional problems are encountered. In particular, building codes and codes of practice require that the covering of the cleanout hole be maintained securely in place as the grouting is added to the wall. Using the makeshift externally anchored coverings described above, however, it is often found that the strain of fluid pressure on the covering will force it out of place, resulting in uneven grouting in the area of the cleanout hole, or leakage of grout out of the opening.

In order to correct the problem of slippage of the cover, it is necessary to expend a large amount of labor in properly setting the cover and bracing it. As a result, the grouting process becomes more and more labor intensive and thus extremely expensive. At the same time, the covers used are not particularly effective and may, indeed, result in defective grouting.

The extreme fluid pressure encountered during grouting is anticipated in the applicable standards set by the "National Concrete Masonry Association." That association states that mortar should be permitted to cure for 24 hours before grouting in order to prevent "blowout" of the mortar joints by the high grouting pressure. In addition, when filling a cavity space between two wythes of masonry, a drying period of not less than 3 days is recommended in order to prevent blowouts. Thus, it can be seen that the pressures encountered in grouting are sufficient to damage the masonry wall itself unless the joints are adequately dried. Obviously, the makeshift covers conventionally used in the art suffer severe problems, particularly since they cannot be anchored directly into the wall itself.

Once the grouting is complete, the cover of the cleanout hole is removed to allow inspection of the grouting fill. If the grouting fill is found to be adequate, the cleanout hole may be covered with a block facing which has a similar appearance to the block used in the remainder of the structure.

In view of the discussion above, it will be appreciated that what is needed in the art are adequate methods and apparatus for filling cleanout holes during grouting. In particular, it would be a significant advancement in the art to provide such methods and apparatus which are not labor intensive in their use. It would also be an advancement in the art to provide such methods and apparatus which were able to withstand the high fluid pressure of grout as it is being filled within a masonry structure by being anchored to the masonry wall itself.

It would be an additional advancement in the art to provide such an apparatus which was easily inserted and removed within a cleanout hole in a masonry structure. It would be a further advancement in the art to provide such an apparatus which was repeatedly usable such that the overall cost of using the apparatus was low. Furthermore, it would be a significant advancement in the art if such methods and apparatus could be developed which were simple and inexpensive to use such that the cost of the overall masonry structure could be reduced. Such methods and apparatus are disclosed and claimed herein.

BRIEF SUMMARY AND OBJECTS OF THE INVENTION

As mentioned above, the present invention is related to tools which are used in masonry work. In particular, the present invention is related to a tool which can be used to temporarily close cleanout holes in masonry construction and which can be securely anchored directly to the masonry wall.

The present invention is essentially comprised of a substantially flat plate of rigid material. The material used to construct the plate may include various metals, including steel, or may include other types of rigid materials which are not easily corroded by the materials used in masonry work. The plate of the present invention is configured such that it fully covers the cleanout holes for which it is designed.

Furthermore, the planar surface of the plate is configured such that it provides an acceptable grout surface on the interior of the cleanout hole once it is filled. For most purposes, it will be appreciated, that a substantially flat plate will be desirable. Securely attached to the plate is a means for locking the plate into position within the cleanout hole and for securing the plate directly to the masonry wall in which the device is used. Various different locking mechanisms are within the scope of the invention, and several are described in full herein.

One locking mechanism is comprised of a locking axle disposed in the general vicinity of the center of the outside face of the plate. Connected to the locking axle, in turn, are a pair of locking arms. The locking arms extend in opposite directions from the locking axle to approximately the outside edges of the plate. By rotating the locking axle it is possible to move the locking arms forward and/or backward with respect to the edge of the plate and to extend the arms beyond the edge of the plate.

Connected to the locking axle is a locking handle. The handle can be used to position the locking arms in the desired position. In order to hold the locking arms in the desired position at the edge of the plate, the locking arms pass through sleeves which are securely attached to the outside face of the plate in the vicinity of the outside edge of the plate.

In operation, it can be appreciated that the plate will be inserted within a cleanout hole. In order to lock the plate in place, the locking handle will be rotated until the locking arms extend past the edge of the plate and engage the walls of the cleanout hole. Once the locking arms so engage the interior walls of the cleanout hole, the locking handle may be placed in position such that slippage does not occur. As a result, the cleanout hole is completely covered and ready for grouting, and the plate is held in place by the masonry wall itself. Once the grouting has been completed, the locking handle is quickly and easily released, the locking arms are retracted, and the plate can easily be removed from the interior of the cleanout hole.

In an alternative embodiment of the present invention, the locking mechanism comprises one or more plungers securely attached to the plate. The plate is positioned in the cleanout hole in the same manner as described above. Once the plate is in place, however, the plunger is extended so it engages the interior walls of the cleanout hole and is locked in place during the grouting process. Once grouting is completed, the plunger can be released and the plate can be removed from the cleanout hole.

In a third embodiments of the present invention, the plate is anchored into the interior of the cleanout hole by an anchor plate. The anchor plate and the primary plate of the present invention are connected through an appropriately linked bolt. The bolt passes through approximately the center of the plate. The bolt then extends into the wall where it attaches to an anchor plate. The anchor plate is somewhat smaller than the primary plate and is configured so that it will be held within the interior of the cleanout hole by the blocks being grouted. Once the grout has flowed into the cleanout hole, the primary plate may be removed. The anchor plate, however, remains permanently imbedded within the wall.

It will be appreciated that each of the three different embodiments of the present invention may be used for different particular uses. The concept of the present invention, however, remains the same. That is, cleanout holes are covered by appropriately shaped and sized plates. These plates are easily locked into place using a locking mechanism. This locking mechanism locks the device directly into the interior of the cleanout hole such that the device is held in place by the masonry wall itself and such that it can withstand the high fluid pressure encountered during grouting procedures. At the same time, the plate of the present invention is easily removed once grouting is completed.

It is, therefore, a primary object of the present invention to provide methods and apparatus for adequately filling cleanout holes during the grouting process.

It is a further object of the present invention to provide such methods and apparatus which are not labor intensive in their use.

It is another object of the present invention to provide methods and apparatus for filling cleanout holes such that the cover over the cleanout hole is locked directly into the masonry wall to be grouted such that it is capable of withstanding the high fluid pressure encountered during grouting.

It is still another object of the present invention to provide an apparatus which can be easily inserted into a cleanout hole before grouting and then can be easily removed after grouting is in place.

It is also an object of the present invention to provide such an apparatus which is reusable.

It is another object of the present invention to provide apparatus and methods for filling cleanout holes which is economical and cost-effective in its application.

These and other objects of the invention will become apparent upon reading the following detailed description and appended claims, and upon reference to the accompanying drawings.

DETAILED DESCRIPTION OF THE PREFERRED EMBODIMENTS

Figure 1:
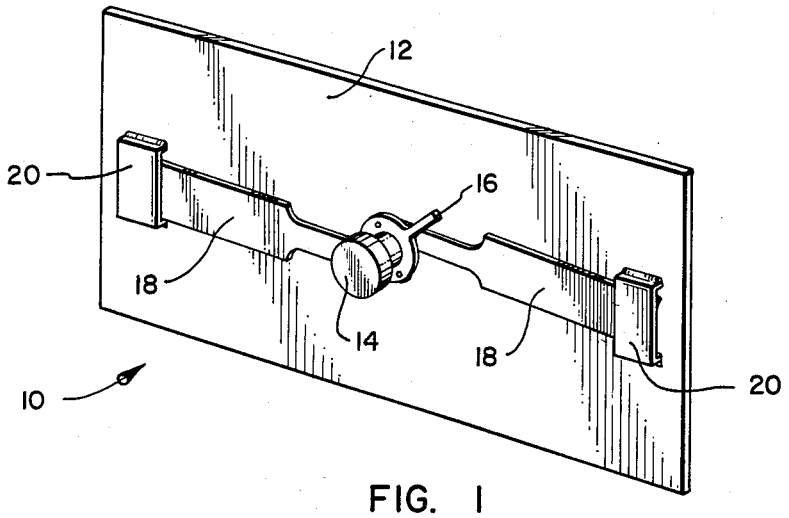
FIG. 1 is a front plan view of a first embodiment of the present invention showing the locking arms in their retracted position.

The present invention can be best understood with reference to the drawings, wherein like parts are designated with like numerals throughout. Referring more particularly to FIG. 1, a first embodiment within the scope of the present invention is illustrated. The present invention is an apparatus for use in covering cleanout holes and the like in masonry construction. It will be appreciated that in the prior art it has been an extremely difficult process to cover cleanout holes while the area is filled with grout. This is because of the extremely high fluid pressure which the grout exerts on any such covering and because of a lack in the existing art of any method for efficiently and effectively covering the cleanout holes as they are filled.

As can be appreciated with reference to FIG. 1, a first preferred embodiment of the present invention is formed of a piece of substantially flat, planar plate. In FIG. 1, the plate is designated 12, and the invention is generally designated 10. Plate 12 may be made of any desirable rigid material. The material which forms plate 12 should be durable and resistant to the elements as well as resistant to the materials with which it will come in contact. These include various components of mortar, grouting, and various masonry units such as block, brick, and stone. One material which has been found to be fully usable and desirable is a mild steel plate.

It will also be appreciated that plate 12 may be made in any configuration necessary to cover the particular type of hole involved. The plate illustrated in FIG. 1 is generally rectangular; however, it will be appreciated that other shapes may also be used including squares, triangles, circles and plates of any particular dimension. It is expected that the device will be used primarily in connection with concrete or structural clay units with dimensions of 6, 8, 10, or 12 inches in width and 4, 6, and 8 inches in height. Thus, it will be appreciated that any size or configuration of cleanout hole may be covered by choosing appropriately the size and configuration of plate 12.

Disposed in approximately the center area of the front face of plate 12 is a locking hub 14. Again, the locking hub 14 may be made of any suitable material, such as a weldable steel. The locking hub 14 primarily provides a point of pivot which allows for operation of the device as a whole. Attached to the locking hub 14 is a locking handle 16. Locking handle 16 facilitates the operation of the device. In particular, locking handle 16 may be rotated in order to lock the device in place within a cleanout hole or to release the device. This mechanism will be discussed in further detail below.

Additional elements of the device include a pair of locking arms 18 which are placed in communication with the locking hub 14. As can be appreciated with reference to FIG. 1, locking arms 18 will extend generally outwardly from the center of the plate while in the location near locking hub 14. Thus, when locking arms 18 are locked in place within a cleanout hole, the locking arms 18 will oppose each other in order to hold plate 12 in place.

In operation, it is simply necessary to rotate locking handle 16. Locking handle 16 in turn causes locking arms 18 to move outwardly or inwardly depending on the direction of movement of locking handle 16.

In order to hold locking arms 18 generally in place, the device as illustrated in FIG. 1 includes a pair of sleeves 20. Sleeves 20 serve to hold locking arms 18 generally in position on the face of plate 12. Sleeves 20, however, are configured such that locking arms 18 can easily slide within them.

Figure 2:
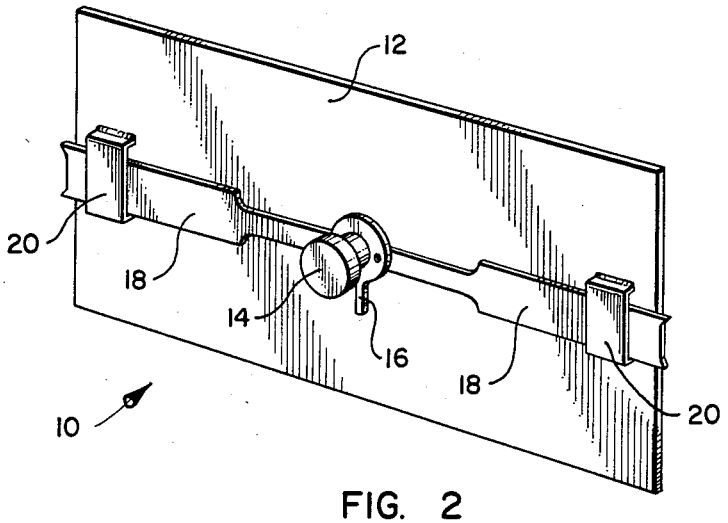
FIG. 2 is a front plan view of the same embodiment of the invention as illustrated in FIG. 1 with the locking arms in the extended position.

Operation of the device 10 can be easily understood by reference to FIGS. 1 and 2. In FIG. 1, locking arms 18 are in the retracted position. In FIG. 2, conversely, the locking handle 16 has been rotated so that locking arms 18 are in their fully extended position. In operation, device 10 is positioned into a cleanout hole with the locking arms 18 in the retracted position, as illustrated in FIG. 1.

Figure 3:
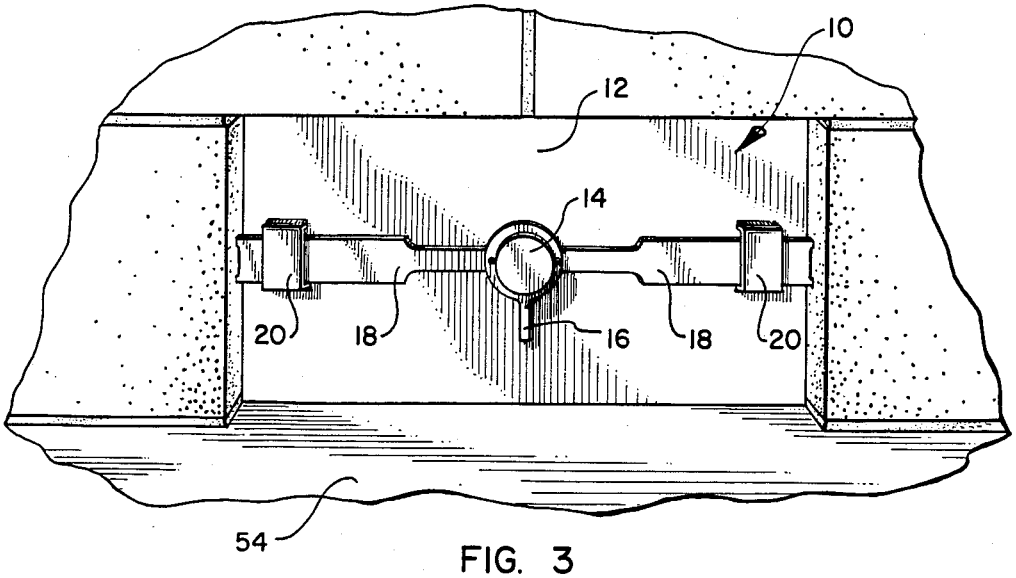
FIG. 3 is a front perspective view of the embodiment of the invention illustrated in FIG. 1 shown in place within a cleanout hole.

Once in place within the cleanout hole, the device is locked into position by extending locking arms 18 by turning locking handle 16. Thus, the device takes the general configuration illustrated in FIG. 2. The operation of the device can be more fully appreciated with reference to FIG. 3 wherein the device illustrated in FIGS. 1 and 2 is illustrated in place within a masonry wall. As shown in FIG. 3, the device is securely anchored to the interior of the cleanout hole and, as a result, to the masonry wall itself. This prevents the slippage and inadequate anchoring experienced in the prior art.

Once the device is in place, as illustrated in FIG. 3, the spaces within the interior of the masonry wall may be fully grouted. Device 10 will then hold the grout in the desired position within the interior of the masonry wall while it is allowed to dry.

Once the grouting procedure has been accomplished and the grout has sufficiently dried, device 10 may be easily removed from the masonry wall. In particular, the locking handle 16 is simply returned to its original unlocked position, as illustrated in FIG. 1. The entire process of inserting and removing the device 10 is extremely simple and takes very little labor. As a result, the use of the device 10 results in an extreme reduction in the cost of grouting procedures. Grouting is securely held in the desired position within the interior of the wall until it is adequately dried. Slippage of the device will be prevented by the locking of the device into the sides of the cleanout hole and, therefore, the masonary wall itself.

Figure 4:
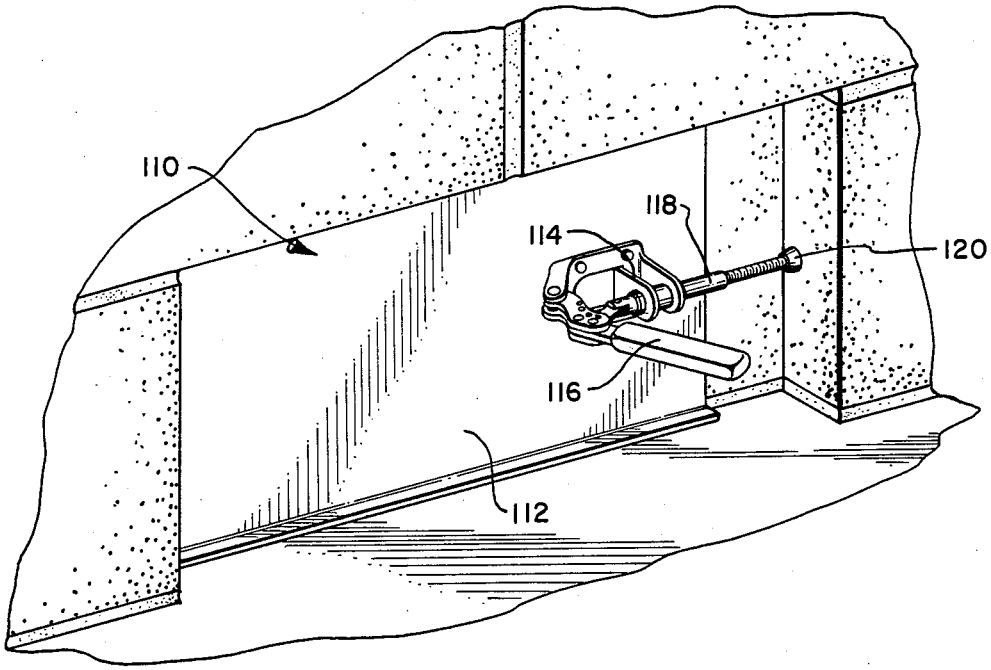
FIG. 4 is a front plan view of a second embodiment of the present invention showing the plunger in the extended position.
Figure 5:
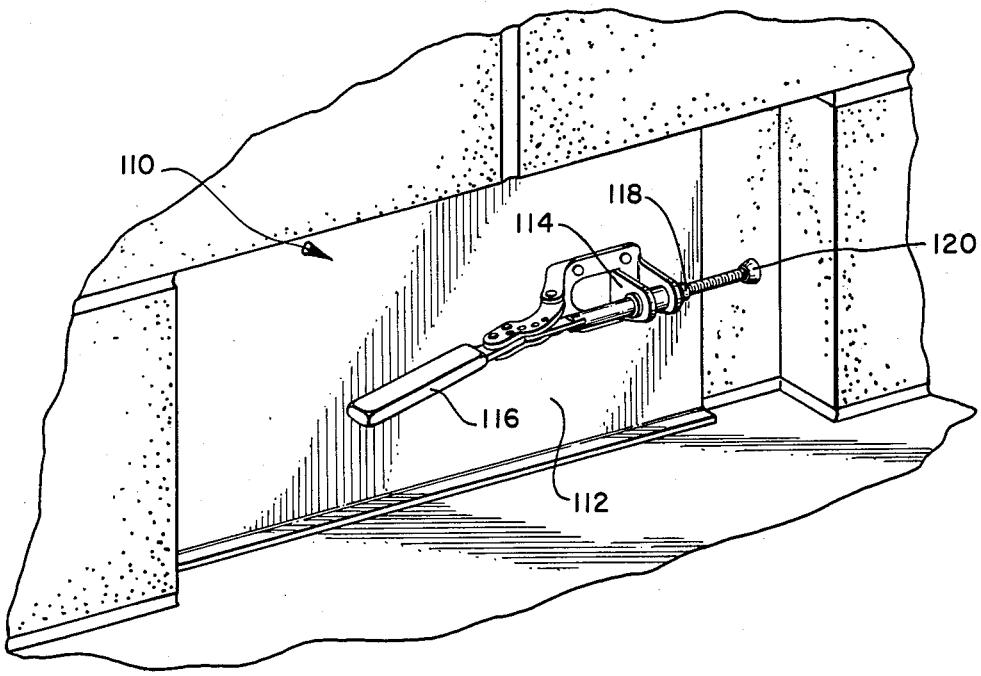
FIG. 5 is a front plan view of the same embodiment of the invention as illustrated in FIG. 3 with the plunger in the retracted position.

An alternative embodiment of the present invention can be understood with reference to FIGS. 4 and 5. Like the embodiment of the device illustrated in FIGS. 1 through 3, the device illustrated in FIGS. 4 and 5 has as its basic structural feature a generally planar plate 112. Like the embodiment of the invention described above, the device illustrated in FIGS. 3 and 4 also has a locking mechanism securely attached to plate 112.

The locking mechanism in the embodiment of FIGS. 3 and 4, however, comprises a plunger mechanism. While it will be appreciated that multiple plungers may be attached to plate 112, the illustrated embodiment shows a single plunger 114 attached to plate 112. The plunger generally includes a plunger mechanism 114, an attached handle 116, and extending outwardly from the edge of plate 112, as illustrated in FIG. 3, the plunger 118. Finally, attached to the end of plunger 118 is a plunger tip 120.

The operation of the device illustrated in FIGS. 4 and 5 is easily understood. In particular, plate 112 is inserted into the desired cleanout hole with the plunger in the retracted position as illustrated in FIG. 5. Once the plate 112 is secured in position, plunger handle 116 is pulled resulting in extension of plunger 118. Thus, plunger tip 120 engages the side of the cleanout hole securing the plate 112 in position. Once the grouting procedure has taken place and is completed, it is a simple matter to remove the device from the cleanout hole. In particular, plunger handle 116 is simply released, thereby withdrawing plunger 118 from the side of the cleanout hole and allowing the plate 112 to be simply lifted out of position.

It will be appreciated with reference to FIGS. 1 through 5 that virtually any type of locking mechanism may be used in connection with the present invention. It is only necessary that the locking mechanism securely lock the device in place such that it is firmly anchored to the interior of the cleanout hole and the masonry wall itself. It is preferable that the locking mechanism be retractable such that it does not extend beyond the outer edges of the plate. In addition, the locking mechanism must be extendable to engage the edges of a cleanout hole in order to hold the plate securely in position and to withstand the relatively large fluid pressure forces caused by large columns of grout being introduced into a masonry wall.

Figure 6:
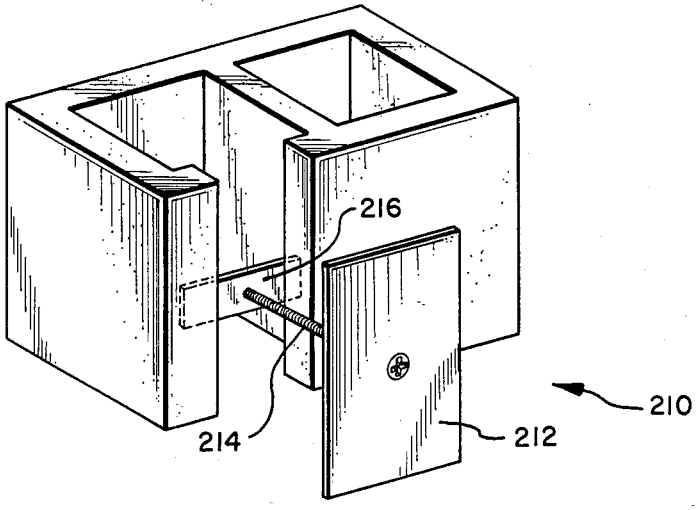
FIG. 6 is a front perspective view of a third embodiment of the present invention.

A third alternative in the embodiment of the present invention is illustrated in FIG. 6. The device 210 illustrated in FIG. 6 is useful where it is necessary or desirable to provide a permanent anchor to the masonry wall as the grout is introduced into the cleanout hole. The device illustrated in FIG. 6 is comprised generally of a plate 212. Attached through the center of the front face of the plate is a bolt 214. In turn, attached to the opposite end of bolt 214 is an anchor plate 216.

The embodiment of the device illustrated in FIG. 6 provides more permanent anchoring of the plate 212 over the opening of the cleanout hole. In particular, anchor plate 216 may be positioned inside of a concrete block such that anchor plate 216 cannot be pulled or otherwise removed from the block. When so positioned, plate 212 may be attached by means of bolt 214 to anchor plate 216. Once this attachment and positioning is completed, grouting of the masonry wall may take place. Once grouting is completed, plate 212 may be removed; however, anchor plate 216 will remain within the mass of grouting which has been added to the wall.

Thus, the embodiment of the device illustrated in FIG. 6 operates essentially along the same lines as the other embodiments of the device. In particular, the embodiment of the device in FIG. 6 employs a plate 212 which is configured such that it will fit over the desired opening. In addition, an anchoring mechanism is provided for holding the plate 212 in position while grouting or other material is added behind plate 212. Like the other embodiments of the device, the device illustrated in FIG. 6 is securely anchored into the cleanout hole and the masonry wall. This is in contrast to prior art methods which employed external anchoring mechanisms.

Figure 7:
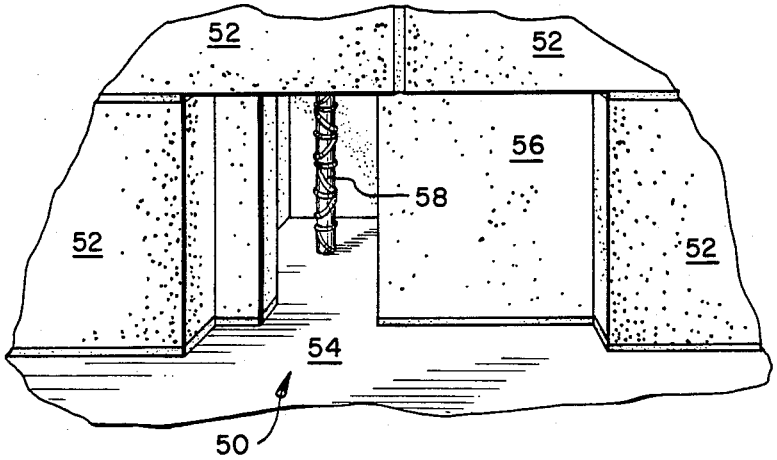
FIG. 7 is a front perspective view of a open cleanout hole before grouting.

In order to further understand the operation of the device, reference is made to FIG. 7. In FIG. 7, a typical cleanout hole 50 is illustrated. Cleanout hole 50 is bordered on three sides by concrete blocks 52. Beneath the concrete blocks 52, and forming the bottom surface of cleanout hole 50, is the foundation 54. In addition, an interior half block 56 is illustrated placed within the cleanout hole. Also positioned within the cleanout hole is a reinforcing rod 58. The reinforcing rod 58 is of the type generally used for reinforcing high-lift masonry construction. Once the masonry wall is fully grouted, reinforcing rod 58 will be totally surrounded by grouting material.

Figure 8:
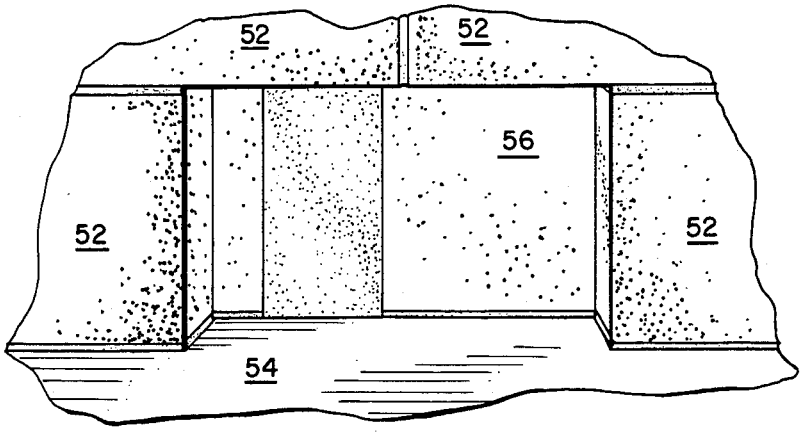
FIG. 8 is a front perspective view of the cleanout hole illustrated in FIG. 7 following grouting.

The finished product can be fully appreciated with reference to FIG. 8. In FIG. 8, the same cleanout hole is illustrated; however, the hole has been fully grouted, and reinforcing rod 58 has become enclosed in the grouting material. At this point in the construction, a simple block facing may be secured over the remaining portion of the cleanout hole so that the entire block wall has a uniform appearance.

The present invention accomplishes all of the objects of the invention set forth above. In particular, the present invention provides a very much improved apparatus and method for covering cleanout holes. The present invention provides a covering for a cleanout hole which is anchored directly into the masonry wall so that it is held securely in place. At the same time, the present invention does not require a great deal of labor and indeed the labor savings over the existing art are substantial. The present invention is able to withstand the high levels of fluid pressure encountered in grouting procedures, and thus the formation of a uniformly grouted wall is assured.

The device of the present invention is easily inserted and removed over the cleanout opening. It is a simple matter to lock the device in place and to remove it when the grouting procedure is completed. In addition, the device as illustrated in FIGS. 1 through 4, and the plate illustrated in FIGS. 5 and 6, are relatively inexpensive to manufacture and are easily reused on repeated grouting procedures. As a result, the present invention makes grouting a much more economical and effective process.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In a device capable of withstanding high levels of fluid pressure for removably covering a cleanout hole in a masonry wall during grouting comprising:

a substantially planar plate which is configured such that it is capable of being placed within a cleanout hole and of substantially covering the cleanout hole, wherein the cleanout hole is bordered on at least two sides by masonry units and wherein the cleanout hole is in communication with a grouting pour; and a retractable engaging member secured to the front face of the plate facing outwardly from the cleanout hole, said retractable engaging member being capable of removably holding the plate in place within the cleanout hole by placing sufficient pressure on the masonry units during grouting such that, due to friction engagement between said retractable engaging member and the masonry units, the plate will not move substantially as the pour is filled with grout and the device is able to withstand the fluid pressure exerted on the plate by the grout placed behind the plate.

2. A device for removably covering a cleanout hole as defined in claim 1 wherein the retractable engaging member comprises a plunger mechanism.

3. A device for removably covering a cleanout hole as defined in claim 2 wherein the plunger mechanism comprises a plunger and a plunger tip.

4. A device for removably covering a cleanout hole as defined in claim 3 wherein the retractable engaging member further comprises a plunger handle in combination with said plunger mechanism.

5. A device for removably covering a cleanout hole as defined in claim 1 wherein the retractable engaging member comprises a locking arm.

6. A device for removably covering a cleanout hole as defined in claim 5 wherein the retractable engaging member further comprises a locking axle securely mounted to the plate and in communication with the locking arm.

7. A device for removably covering a cleanout hole as defined in claim 6 wherein the retractable engaging member further comprises a locking handle which is capable of moving the locking axle alternatively to the locked and unlocked positions.

8. A device for removably covering a cleanout hole as defined in claim 7 further comprising sleeves mounted to the front face of the plate through which said locking arms pass.

9. A device for removably covering a cleanout hole as defined in claim 1 wherein the retractable member comprises a bolt extending in a generally perpendicular angle from the front face of the plate rearwardly into the cleanout hole.

10. A device for removably covering a cleanout hole as defined in claim 9 further comprising an anchor plate securely attached to the bolt at a point distal from the point of attachment between the plate and the bolt, said anchor plate engaging the masonry units.

11. In a device capable of withstanding high levels of fluid pressure for removably filling an opening in a masonry wall while the wall is being grouted, comprising:

a substantially planar plate which is configured such that when in position within the opening in a masonry wall, the plate covers substantially the entire subject opening, wherein the opening is a cleanout hole bordered on at least two sides by masonry units and wherein the cleanout hole is in communication with a grouting pour; and a retractable engaging member securely mounted to the front face of the plate facing outwardly from the cleanout hole, said retractable engaging member being capable of holding the plate sufficiently securely in position within the opening in the masonry wall that, due to friction engagement between said retractable engaging member and the masonry units forming the cleanout hole, the plate will not move substantially and the plate is able to withstand the fluid pressure exerted on the plate by grout placed behind the plate, said retractable engaging member having means for securely locking the retractable engaging member into position.

12. A device for removably filling an opening in a masonry wall as defined in claim 11 wherein the plunger mechanism comprises a plunger and a plunger tip.

13. A device for removably filling an opening in a masonry wall as defined in claim 12 wherein the means for securely locking the retractable engaging member in position comprises a plunger handle in combination with said plunger mechanism.

14. A device for removably filling an opening in a masonry wall as defined in claim 11 wherein the retractable member comprises a locking arm.

15. A device for removably filling an opening in a masonry wall as defined in claim 14 wherein the locking means comprises a locking axle securely mounted to the plate and in communication with the locking arm.

16. A device for removably filling an opening in a masonry wall as defined in claim 15 wherein the locking means further comprises a locking handle which is capable of moving the locking axle alternatively to the locked and unlocked positions.

17. A device for removably filling an opening in a masonry wall as defined in claim 16 further comprising sleeves mounted to the front face of the plate through which said locking arms pass.

18. A device for removably filling an opening in a masonry wall as defined in claim 11 wherein the retractable member comprises a bolt extending in a generally perpendicular angle from the front face of the plate rearwardly into the opening.

19. A device for removably filling an opening in a masonry wall as defined in claim 18 further comprising an anchor plate securely attached to the bolt at a point distal from the point of attachment between the plate and the bolt.

20. A device for removably filling an opening in a masonry wall as defined in claim 11 wherein the plate is made of steel.

21. In a device capable of withstanding high levels of fluid pressure for covering an opening in the masonry wall during grouting comprising:

a substantially planar plate configured such that when in position within the subject opening, the plate covers substantially the entire opening, wherein the opening is a cleanout hole bordered on at least two sides by masonry units and wherein the cleanout hole is in communication with a grouting pour; and a retractable engaging member securely mounted to the front face of the plate extending outwardly from the cleanout hole such that the plate can be securely locked into position within the opening and engaging the sides of the opening such that, due to friction engagement between the locking mechanism and the sides of the opening, the plate will not move substantially as the opening is filled with grout, wherein the device is able to withstand the fluid pressure exerted on the plate by the grout placed behind the plate, the retractable engaging member comprising:

a locking axle securely attached to the center region of the front face of the plate;

a plurality of locking arms attached to the locking axle and being of sufficient length to extend from the locking axle beyond the outer edge of the plate; and a locking handle attached to the locking axle such that movement of the locking handle causes the locking arms to move alternatively from an extended position to a retracted position.

22. A device for covering an opening in a masonry wall as defined in claim 21 further comprising a plurality of sleeves securely attached to the front face of the plate such that the locking arms can extend through said sleeves.

23. In a device capable of withstanding high levels of fluid pressure for covering an opening in a masonry wall during grouting comprising:

a substantially planar plate configured such that when in position within the subject opening, the plate covers substantially the entire opening, wherein the opening is a cleanout hole bordered on at least two sides by masonry units and wherein the cleanout hole is in communication with a grouting pour; and a retractable engaging member securely mounted to the front face of the plate extending outwardly from the cleanout hole such that the plate can be securely locked into position within the opening and engaging the sides of the opening such that, due to friction engagement between the locking mechanism and the sides of the opening, the plate will not move substantially as the opening is filled with grout, wherein the device is able to withstand the fluid pressure exerted on the plate by the grout placed behind the plate, the retractable engaging member comprising:

at least one plunger mechanism having a plunger which is sufficiently long to extend from its point of attachment beyond the outer edge of the plate and a plunger handle attached to said plunger mechanism such that movement of the plunger handle causes the plunger to move alternatively from an extended position to a retracted position.

24. In a device capable of withstanding high levels of fluid pressure for covering an opening in a masonry wall during grouting comprising:

a substantially planar plate configured such that when in position within the opening, the plate covers substantially the entire opening, wherein the opening is a cleanout hole bordered on at least two sides by masonry units and wherein the cleanout hole is in communication with a grouting pour;

a locking mechanism securely mounted to the plate such that the plate can be securely locked into position within the opening and engaging the masonry units such that the plate will not move substantially as the opening is filled with grout, the locking mechanism comprising:

a bolt extending in a generally perpendicular direction from the front face of the plate rearwardly into the opening and being securely attached at its distal end to an anchor plate, said anchor plate being capable of being securely disposed and remaining permanently within the opening such that the device is able to withstand the fluid pressure exerted on the plate by the grout placed behind the plate.

* * * * *